US011953207B1

(12) United States Patent
Weilert et al.

(10) Patent No.: US 11,953,207 B1
(45) Date of Patent: Apr. 9, 2024

(54) COMBUSTIBLE FUEL BURNING FIRE PIT

(71) Applicant: Solo Brands, LLC, Grapevine, TX (US)

(72) Inventors: Jeffrey R. Weilert, Southlake, TX (US); Alexander K. Maghsadi, Lewisville, TX (US)

(73) Assignee: Solo Brands, LLC, Grapevine, TX (US)

( * ) Notice: Subject to any disclaimer, the term of this patent is extended or adjusted under 35 U.S.C. 154(b) by 0 days.

(21) Appl. No.: 18/389,667

(22) Filed: Dec. 19, 2023

Related U.S. Application Data

(63) Continuation of application No. 17/169,269, filed on Feb. 5, 2021, now Pat. No. 11,879,641.

(51) Int. Cl.

| | |
|---|---|
| ***F24B 1/18*** | (2006.01) |
| ***F24B 5/02*** | (2006.01) |
| ***F24C 15/08*** | (2006.01) |
| *F24B 13/00* | (2006.01) |

(52) U.S. Cl.
CPC ..... *F24B 1/18* (2013.01); *F24B 5/021* (2013.01); *F24C 15/08* (2013.01); *F24B 13/008* (2013.01)

(58) Field of Classification Search
CPC ..... F24B 1/18; F24B 5/021; F24B 13/008; F24C 15/08
USPC ..... 126/25 R
See application file for complete search history.

(56) References Cited

U.S. PATENT DOCUMENTS

| | | | | |
|---|---|---|---|---|
| 500,239 | A * | 6/1893 | Loeble et al. | B23K 3/027 16/18 R |
| 685,194 | A | 10/1901 | Young | |
| 904,188 | A | 11/1908 | Engle | |
| 1,298,762 | A | 4/1919 | Milligan | |

(Continued)

FOREIGN PATENT DOCUMENTS

| | | |
|---|---|---|
| CN | 2035756 | 4/1989 |
| JP | 10-323289 A | 12/1998 |

(Continued)

OTHER PUBLICATIONS

International Search Authority, International Search Report and Written Opinion, ISA/KR, PCT/US2019/063180, dated Mar. 26, 2020, 10 pages.

(Continued)

*Primary Examiner* — Avinash A Savani
(74) *Attorney, Agent, or Firm* — Haynes and Boone, LLP

(57) ABSTRACT

A fire pit is disclosed that includes a burn chamber, a removable fire grate, and a removable ash pan. The burn chamber is defined by an inwardly facing surface and a bottom. The removable fire grate is positioned within the burn chamber and supports combustible fuel for burning. The removable fire includes a plurality of holes sized to permit passage of ash from the combustible fuel, and at least one grip feature sized and shaped to permit a user to remove the removable fire grate from the fire pit by lifting the removable fire grate vertically through the burn chamber. The removable ash pan is positioned within the burn chamber beneath the removable fire grate, and includes, a side wall, a bottom, and at least one grippable surface configured to permit the user to remove the removable ash pan from the fire pit by lifting the removable ash pan vertically through the burn chamber.

27 Claims, 7 Drawing Sheets

(56) References Cited

U.S. PATENT DOCUMENTS

| | | | | |
|---|---|---|---|---|
| D54,930 | S | 4/1920 | Knapp | |
| D74,996 | S | 2/1928 | Wolcott | |
| 1,694,175 | A | 12/1928 | Hauser | |
| D100,012 | S | 6/1936 | Ford | |
| 2,614,553 | A | 10/1952 | Cox | |
| 2,676,583 | A * | 4/1954 | Blumson | F23B 50/06 126/76 |
| 2,722,883 | A | 11/1955 | Rignell | |
| 2,738,225 | A | 3/1956 | Meek | |
| D196,018 | S | 8/1963 | Palmer et al. | |
| 3,756,218 | A | 9/1973 | Simpson | |
| D229,013 | S | 11/1973 | Storandt | |
| D229,277 | S | 11/1973 | Chan | |
| 3,790,081 | A | 2/1974 | Thornton | |
| 3,937,138 | A | 2/1976 | Tidwell | |
| 3,951,082 | A | 4/1976 | Leggett | |
| D258,259 | S | 2/1981 | Lindholm | |
| D258,712 | S | 3/1981 | Jacobson | |
| D273,264 | S | 4/1984 | Elliston | |
| 4,454,828 | A * | 6/1984 | Zempel | F23B 50/12 110/294 |
| 4,735,135 | A | 4/1988 | Walker | |
| 4,903,683 | A | 2/1990 | Larsen | |
| 5,024,208 | A | 6/1991 | Hottenroth et al. | |
| 5,117,558 | A | 6/1992 | Hull | |
| D355,809 | S | 2/1995 | Kothrade | |
| D358,204 | S | 5/1995 | Ferrier | |
| 5,490,452 | A | 2/1996 | Schlosser et al. | |
| D379,900 | S | 6/1997 | Gillam | |
| 5,638,808 | A | 6/1997 | Home | |
| 5,651,356 | A | 7/1997 | Kaines | |
| 5,797,386 | A | 8/1998 | Orr | |
| 5,809,988 | A | 9/1998 | Wagner | |
| 6,024,081 | A | 2/2000 | Libertini | |
| D422,452 | S | 4/2000 | Persson | |
| D435,191 | S | 12/2000 | Cooper | |
| 6,196,121 | B1 | 3/2001 | Crowl | |
| 6,196,215 | B1 | 3/2001 | Chandaria | |
| D442,422 | S | 5/2001 | Dabney | |
| D444,991 | S | 7/2001 | Measom | |
| 6,314,955 | B1 | 11/2001 | Boetcker | |
| 6,393,717 | B1 | 5/2002 | Santos | |
| 6,488,023 | B2 | 12/2002 | Pecoskie | |
| D488,023 | S | 4/2004 | Siegel et al. | |
| D491,409 | S | 6/2004 | Siegel et al. | |
| D495,552 | S | 9/2004 | Siegel et al. | |
| D531,849 | S | 11/2006 | Turner | |
| D534,756 | S | 1/2007 | Jensen | |
| D607,265 | S | 1/2010 | Gaunaurd, III | |
| D612,191 | S | 3/2010 | Taber et al. | |
| D612,662 | S | 3/2010 | Lorenz et al. | |
| D618,038 | S | 6/2010 | Davies et al. | |
| 7,810,484 | B2 | 10/2010 | Schlosser | |
| D644,474 | S | 9/2011 | Wilgus et al. | |
| 8,087,410 | B2 | 1/2012 | Gregory | |
| D658,426 | S | 5/2012 | Saunders | |
| D683,999 | S | 6/2013 | Karlsson | |
| D701,721 | S | 4/2014 | Jan | |
| 8,991,382 | B1 | 3/2015 | Mau | |
| 9,844,300 | B2 | 12/2017 | Cedar | |
| 10,098,502 | B2 | 10/2018 | Ohler | |
| 10,125,995 | B2 | 11/2018 | Kohli | |
| 10,222,092 | B1 | 3/2019 | Traeger | |
| D858,729 | S | 9/2019 | Scott | |
| D923,163 | S | 6/2021 | Jan | |
| 11,092,342 | B2 | 8/2021 | Harrington et al. | |
| 11,293,642 | B2 | 4/2022 | Jan et al. | |
| 2006/0219233 | A1 | 10/2006 | Sorenson | |
| 2007/0137634 | A1 | 6/2007 | Traeger et al. | |
| 2009/0165772 | A1 | 7/2009 | Hunt | |
| 2010/0043775 | A1 | 2/2010 | Phillips | |
| 2011/0180527 | A1 | 7/2011 | Abbott | |
| 2012/0017884 | A1 | 1/2012 | Van Den Hoff | |
| 2014/0007778 | A1 | 1/2014 | Marks | |
| 2014/0026765 | A1 | 1/2014 | Fou | |
| 2014/0165993 | A1 | 6/2014 | Ahmed | |
| 2014/0238378 | A1 | 8/2014 | Scott | |
| 2015/0068512 | A1 | 3/2015 | Mehler | |
| 2015/0110939 | A1 | 4/2015 | Benson et al. | |
| 2015/0211743 | A1 | 7/2015 | DeFoort et al. | |
| 2017/0363325 | A1 | 12/2017 | Diurlin et al. | |
| 2019/0313851 | A1 | 10/2019 | Shemp | |
| 2020/0309369 | A1 | 10/2020 | Jan et al. | |
| 2021/0018180 | A1 | 1/2021 | Jan | |
| 2021/0048188 | A1 | 2/2021 | Harrington et al. | |
| 2021/0199301 | A1 | 7/2021 | Poggi et al. | |
| 2021/0274970 | A1 | 9/2021 | Stoltzfus | |
| 2021/0282592 | A1 | 9/2021 | Jan et al. | |

FOREIGN PATENT DOCUMENTS

| | | |
|---|---|---|
| JP | 2000-342462 | 12/2000 |
| JP | 2003-190011 A | 7/2003 |
| KR | 20-0295935 | 11/2002 |
| KR | 10-0898493 | 5/2009 |
| KR | 1020200122766 | 10/2020 |
| WO | WO 2017078762 | 5/2017 |

OTHER PUBLICATIONS

International Search Authority, International Search Report and Written Opinion, PCT/US2021/020687, dated Aug. 5, 2021, 11 pages.

Korean Intellectual Property Office, International Search Report and Written Opinion, PCT/US2022/011365, dated May 3, 2022, 12 pages.

Screen captures from YouTube video clip entitled "Solo Stove Bonfire: Best Gear of 2017," 4 pages, uploaded on May 14, 2017 by user "Canadian Prepper". Retrieved from Internet: https://www.youtube.com/watch?v=Vo_J_flWq5g.

Camping stove, https://www.kickstarter.com/projects/340672218/solo-stove-campfire-backpack-camp-survive/description, 21 pages (2014).

Solo Stove, webpage capture: https://www.solostove.com/solo-stove-bonfire, 2017, 8 pages.

* cited by examiner

COMBUSTIBLE FUEL BURNING FIRE PIT

RELATED APPLICATION

This application is a continuation of U.S. application Ser. No. 17/169,269, filed Feb. 5, 2021, titled Combustible Fuel Burning Fire Pit with Removable Fire Grate and Ash Pan, which is incorporated herein in its entirety.

TECHNICAL FIELD

The subject matter described herein relates to a combustible fuel burning fire pit with a removable fire grate and ash pan. The fire pit has particular but not exclusive utility for portable back yard firepits.

BACKGROUND

Portable wood burning stoves are used in camping for heat and cooking. Similarly, large portable firepits are used for example in residential back yards for recreation, to provide outdoor heat, and to support limited cooking such as marshmallow roasting.

Large firepits are a type of stove that is generally fueled by piles of logs, whereas portable wood stoves may be fueled by twigs and sticks. A fire grate may therefore be used within the fire pit to support this fuel during combustion. Ash may fall through the fire grate into the bottom of the fire pit structure. Removing this ash from the structure may require rolling or inverting the structure—an operation that may be strenuous and/or inconvenient for many users. Cleaning the fire grate, and the fire pit structure beneath the fire grate, may also be challenging.

It is therefore to be appreciated that such commonly used firepits could be improved by simplifying cleaning and ash removal, among others. Accordingly, a need exists for firepits that address the forgoing and other concerns.

The information included in this Background section of the specification, including any references cited herein and any description or discussion thereof, is included for technical reference purposes only and is not to be regarded as subject matter by which the scope of the disclosure is to be bound.

SUMMARY

Disclosed is a wood burning fire pit with removable fire grate and ash pan. The fire pit disclosed herein has particular, but not exclusive, utility for portable firepits.

One general aspect includes a fire pit with a burn chamber defined by an inwardly facing surface and a bottom; a removable fire grate disposed within the burn chamber and disposed to support combustible fuel for burning, the removable fire grate including: a plurality of holes sized to permit passage of ash from the combustible fuel; and at least one grip feature sized and shaped to permit a user to remove the removable fire grate from the fire pit by lifting the removable fire grate vertically through the burn chamber. The fire pit also includes a removable pan disposed within the burn chamber and beneath the removable fire grate, the removable pan including: a side wall and a bottom, and at least one grippable surface configured to permit the user to remove the removable pan from the fire pit by lifting the removable pan vertically through the burn chamber.

Implementations may include one or more of the following features. In some embodiments, at least one of the removable fire grate or the removable pan includes a generally circular shape, a width of the removeable fire grate being greater than a width of the removeable pan. In some embodiments, the removable fire grate includes a dome-shaped portion including a spherical section with a radius of curvature larger than one-half of a width of the removable fire grate. In some embodiments, the removable pan includes at least two downward-projecting feet, where the at least two downward-projecting feet form an air gap beneath the bottom of the removable pan. In some embodiments, the surface includes at least raised or lowered positioning feature sized and shaped to receive at least a portion of the at least two downward-projecting feet. In some embodiments, a diameter of the removable pan is less than a diameter of the burn chamber, such that an air gap is formed between the side wall of the removable pan and an inner wall of the burn chamber. In some embodiments, a volume of the removable pan is determined at least in part by the diameter of the removable pan and a height of the side wall of the removable pan. In some embodiments, the fire pit further includes: an outer wall; and an inner wall spaced from the outer wall by a gap, the inner wall forming the burn chamber. In some embodiments, the removable pan includes at least one handle. In some embodiments, the removable pan includes at least one ventilation hole. In some embodiments, the inwardly facing surface and the bottom are devoid of user access openings to the pan. In some embodiments, the raised central feature includes a cone or tower. In some embodiments, the shape of the removable fire grate is configured to enable production by stamping a flat blank of metallic material.

One general aspect includes a removable fire grate for a combustion fire pit. The removable fire grate includes a domed shape having a center and a perimeter, where the center is higher than the perimeter; a plurality of radial stiffening ribs extending away from the perimeter and toward the center, at least one circumferential stiffening ring extending at least partially about the center, a plurality of ventilation holes between the center and the perimeter, and at least one grip feature sized and shaped to permit a user to remove the removable fire grate from the combustion fire pit by lifting the removable fire grate vertically.

One general aspect includes a removable ash pan for a combustion fire pit. The removable ash pan includes a side wall; a bottom; an ash-storing capacity determined at least in part by a height of the side wall and width of the bottom; at least one grippable surface configured to permit a user to remove the removable ash pan from the combustion fire pit by lifting the removable ash pan vertically; and at least two downward-projecting feet at the bottom, where the at least two downward-projecting feet form an air gap beneath the bottom, where an outer width of the removable ash pan is less than an inner width of an inner wall of the combustion fire pit, such that an air gap is formed between the side wall of the removable ash pan and the inner wall of the combustion fire pit.

Implementations may include one or more of the following features. In some embodiments, the at least two downward-projecting feet are sized and shaped to be received by one or more positioning features disposed within the combustion fire pit beneath the removable ash pan. In some embodiments, the shape of the removable ash pan is configured to enable production by stamping a flat blank of metallic material.

One general aspect includes a system for burning a solid fuel to produce heat. The system includes an inner wall having a lower portion and an upper portion; an outer wall having a lower portion and an upper portion; an air-filled space between the inner wall and the outer wall; a burn chamber formed by the inner wall; a combustion area situated within the burn chamber; at least one ventilation hole within the upper portion of the inner wall; at least one ventilation hole within the lower portion of the outer wall; a removable fire grate disposed within the combustion area and configured to support the solid fuel, the removable fire grate including: a domed shape having a center and a perimeter, where the center is higher than the perimeter; a plurality of ventilation holes between the center and the perimeter; and at least one grip feature sized and shaped to permit a user to remove the removable fire grate from the burn chamber by lifting the removable fire grate vertically through the burn chamber. The system also includes a removable ash pan disposed within the burn chamber beneath the removable fire grate, the removable ash pan including: a side wall; a bottom; an ash-storing capacity determined at least in part by a height and diameter of the side wall; at least one grippable surface configured to permit the user to remove the removable ash pan from the burn chamber by lifting the removable ash pan vertically through the burn chamber; and at least two downward-projecting feet, where the at least two downward-projecting feet form an air gap beneath the bottom of the removable ash pan, where an outer diameter of the removable ash pan is less than an inner diameter of the inner wall, such that an air gap is formed between the side wall of the removable ash pan and the inner wall, where the at least two downward-projecting feet are sized and shaped to be received by one or more positioning features disposed within the burn chamber beneath the removable ash pan.

In some embodiments, the removable ash pan is configured to receive, through the plurality of ventilation holes of the removable fire grate, ash produced by the burning of the solid fuel.

This Summary is provided to introduce a selection of concepts in a simplified form that are further described below in the Detailed Description. This Summary is not intended to identify key features or essential features of the claimed subject matter, nor is it intended to limit the scope of the claimed subject matter. A more extensive presentation of features, details, utilities, and advantages of the fire grate, as defined in the claims, is provided in the following written description of various embodiments of the disclosure and illustrated in the accompanying drawings.

BRIEF DESCRIPTION OF THE DRAWINGS

Illustrative embodiments of the present disclosure will be described with reference to the accompanying drawings, of which.

DETAILED DESCRIPTION

Figure 1:
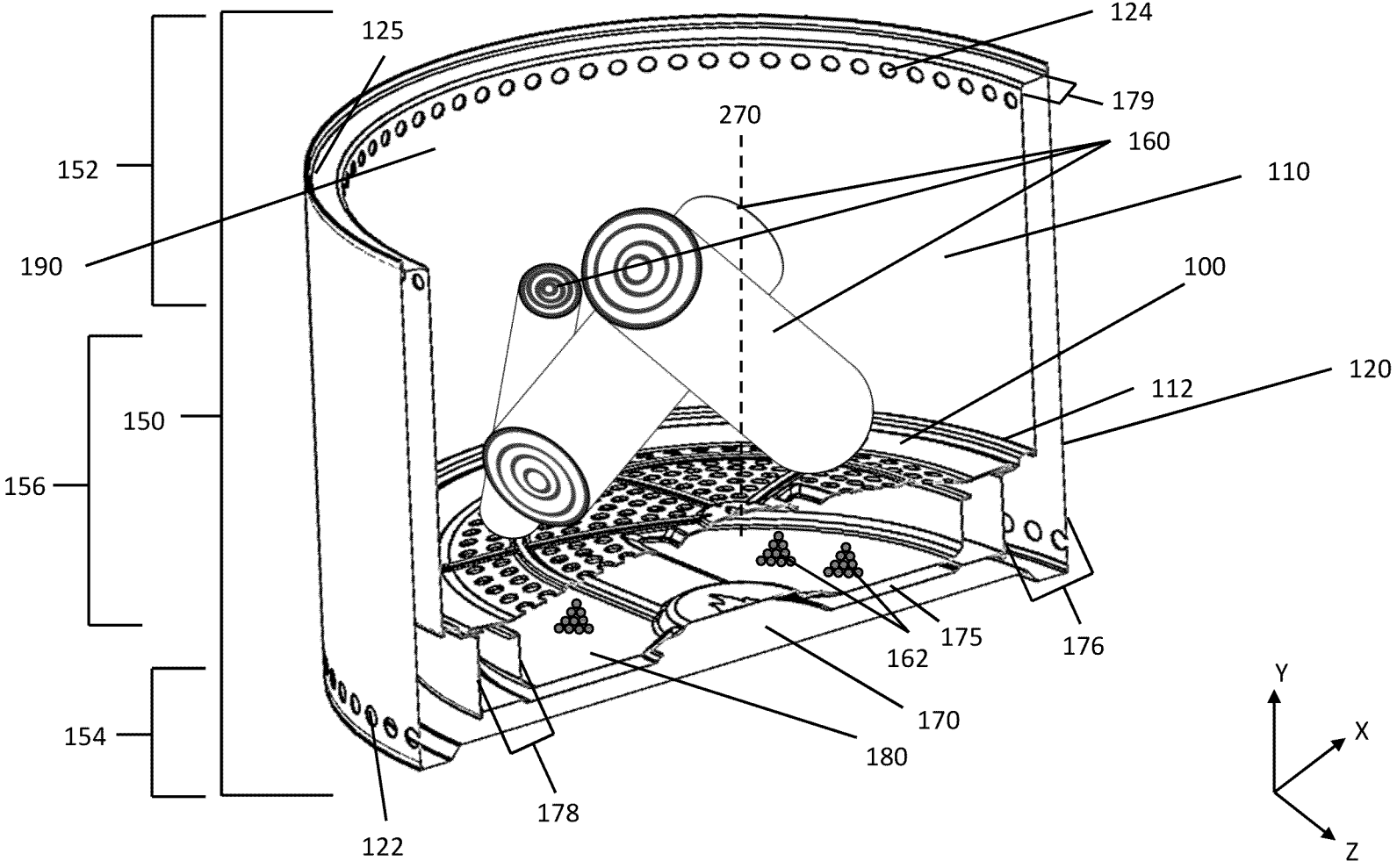
FIG. 1 is a cross-sectional view of an example combustion fire pit including a removable fire grate and removable ash pan, in accordance with at least one embodiment of the present disclosure.

In accordance with at least one embodiment of the present disclosure, a fire pit is provided which includes novel structural features to permit easy removal and cleaning of a fire grate and ash pan. These features provide the necessary functional performance to support combustion of potentially heavy fuel loads at high temperature, while permitting a relatively low weight for the fire pit structure. The disclosed fire pit also includes air flow features conducive to thorough combustion of fuel, which leads to greater heat generation and substantially reduced smoke. Wood or other combustible solid fuel is supported by the fire grate during combustion. Any ash generated by the combustion falls through the fire grate and into an ash pan. To facilitate cleaning and ash removal, both the fire grate and the ash pan may be lifted vertically out of the fire pit structure. Ash may then be dumped out of the ash pan (e.g., into a trash receptacle), and optionally the ash pan and/or fire grate may be cleaned (e.g., with a brush or garden hose). The ash pan and fire grate may then be replaced into the fire pit structure, such that the fire pit is again ready for use.

Disclosed is a fire pit with removable fire grate and ash pan. The fire pit disclosed herein has particular, but not exclusive, utility for portable back yard firepits.

For the purposes of promoting an understanding of the principles of the present disclosure, reference will now be made to the embodiments illustrated in the drawings, and specific language will be used to describe the same. It is nevertheless understood that no limitation to the scope of the disclosure is intended. Any alterations and further modifications to the described devices, systems, and methods, and any further application of the principles of the present disclosure are fully contemplated and included within the present disclosure as would normally occur to one skilled in the art to which the disclosure relates. In particular, it is fully contemplated that the features, components, and/or steps described with respect to one embodiment may be combined with the features, components, and/or steps described with respect to other embodiments of the present disclosure. For the sake of brevity, however, the numerous iterations of these combinations will not be described separately.

These descriptions are provided for exemplary purposes only, and should not be considered to limit the scope of the removable fire grate, removable ash pan, or fire pit. Certain features may be added, removed, or modified without departing from the spirit of the claimed subject matter.

FIG. 1 is a cross-sectional view of an example combustion fire pit, such as a wood burning fire pit 150 including a removable fire grate 100 and removable ash pan 180, in accordance with at least one embodiment of the present disclosure. The fire grate 100 sits within the fire pit 150 and supports the weight of fuel 160 (e.g., wooden logs and sticks) while permitting air flow through the fire grate 100 and fire pit 150 to facilitate combustion of the fuel 160. The fire grate 100 is strong and stiff to bear the weight of firewood and other fuel 160, both at ambient temperatures and at operating temperatures, and may resist substantial warping or other substantial deformation despite prolonged and repeated exposure to the heat of combustion. In an example, operating temperatures may reach about 1350° F. (732° C.), while the temperature of the fire pit under ambient, non-operating conditions may vary from about −40° F. (−40° C.) to about 120° F. (49° C.). The removable fire grate 100 may also be lighter and have greater airflow than other fire grates of comparable size.

In the example embodiment of FIG. 1, the combustion fire pit 150 includes a top portion 152, a bottom portion 154, and a middle portion 156. The firepit 150 further includes an inner wall or inner body 110, an outer wall or outer body 120, a connecting ring 125 located in the top portion 152 of the fire pit 150 and attached to or formed as a single piece with the inner body 110 and the outer body 120, and a cavity or burn chamber 190 defined by an inwardly facing surface of the inner body 110, within which the fire grate 100 is positioned. The fire pit 150 further includes a top lip 115 attached to or formed as a single piece with either of the inner body 110 or outer body 120. The fire pit 150 further includes a plurality of outer ventilation holes 122 located in the bottom portion 154 of the outer body 120, and a plurality of inner ventilation holes 124 located in the top portion 152 of the inner body 110. In the middle portion 156 of the fire pit 150, the inner body 110 terminates in an upward-facing support lip or rollover 112 into which the fire grate 100 fits, or upon which the fire grate 100 rests The fire pit 150 further includes a base plate 170 attached to the outer body 120, a bracing tray 175 supported by stands projecting upward from the base plate, and a removable ash pan 180 supported by stands or feet projecting downward from the ash pan 180 into a receiving feature of the bracing tray 175, such that the bracing tray is separated from the outer body by an air gap 176, the ash pan 180 is separated from the outer body 120 by an air gap 178, and the inner body is separated from the outer body by an air gap 179. In an example, air gaps 176 and 179 are both about 50 mm, while air gap 178 is about 100 mm, although other air gaps may be employed that have the disclosed, advantageous effect.

The cavity or burn chamber 190 is in fluid communication with the air gap 179 via the inner ventilation holes 124, and with air gaps 178 and 176 via the fire grate 100. The air gaps 176 and 178 are in fluid communication with ambient air via the outer ventilation holes 122, such that ambient air may be drawn in through the outer ventilation holes 122, heated by combustion of the fuel 160, and expelled through the cavity or burn chamber 190 and inner ventilation holes 124 to produce advantageous combustion of the fuel 160.

In an example, the fire grate 100, ash pan 180, and other structure of the firepit 150 are made of stainless steel plates having a thickness within a range of between about 0.5 mm and about 2.5 mm thick. Some examples of the fire grate 100, ash pan 180, and the firepit 150 are formed of 1.0 mm to 2.0 mm thick stainless steel, and one example is about 1.5 mm thick stainless steel. Both thicker and thinner materials are contemplated, including other metals. In an example, the fire grate 100 weighs approximately 48 lb (21.8 kg), although weights of between about 9 oz and about 88 lb may be provided. In an example, during normal operation the fire grate 100 supports a nominal weight of 100 lb (45.4 kg), (although nominal capacities of between about 5 lb and about 190 lb may be provided), while the fire grate 100, or portions thereof, are heated to between about 700° F. (371° C.) and about 1350° F. (732° C.) by the combustion of the fuel 160, for a time period of between 1 and 12 hours, and also at ambient temperatures as low as −40° F. (−40° C.). In an example, during normal operation over a period of years, with repeated cycling (e.g., one hundred cycles) between ambient and operational temperatures, the fire grate 100 exhibits little or no warping that would detrimentally affect its aesthetic appearance, its performance, or its fit within the firepit 150.

In an example, the fuel 160 combusts into ash 162, which falls through the fire grate 100 into the ash pan 180. To facilitate cleaning and ash removal, the fire grate 100 can be removed from the fire pit 150 by lifting it vertically upward, in a direction parallel to axis 270, through the cavity or burn chamber 190. This permits user access to the ash pan 180, which can then also be removed from the fire pit by lifting vertically through the cavity or burn chamber 190. The ash pan 180 may then be emptied and optionally cleaned. The fire grate 100 may also optionally be cleaned, and then the ash pan 180 and fire grate 100 returned into the fire pit 150 as shown in FIG. 1.

The primary load carried by the fire grate 100 is applied downward, in a direction parallel to axis 270, by the weight of the fuel 160 piled on the fire grate 100, which is supported by the upward-facing lip or rollover 112 of the inner body 110.

Figure 2:
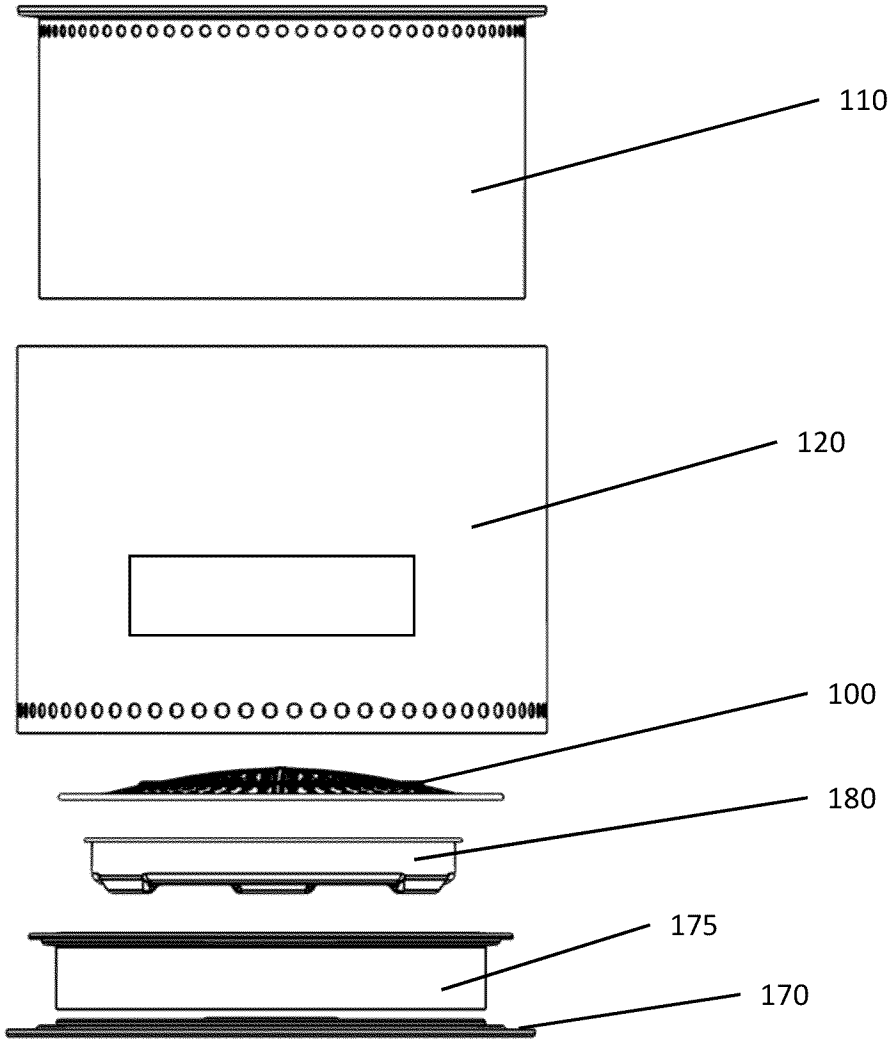
FIG. 2 is an exploded, side view of the fire pit with removable fire grate and ash pan, in accordance with at least one embodiment of the present disclosure.

FIG. 2 is an exploded, side view of the fire pit 150 with removable fire grate and ash pan, in accordance with at least one embodiment of the present disclosure. Visible are the inner body 110, outer body 120, fire grate 100, ash pan 180, bracing tray 175, and base plate 170.

Figure 3:
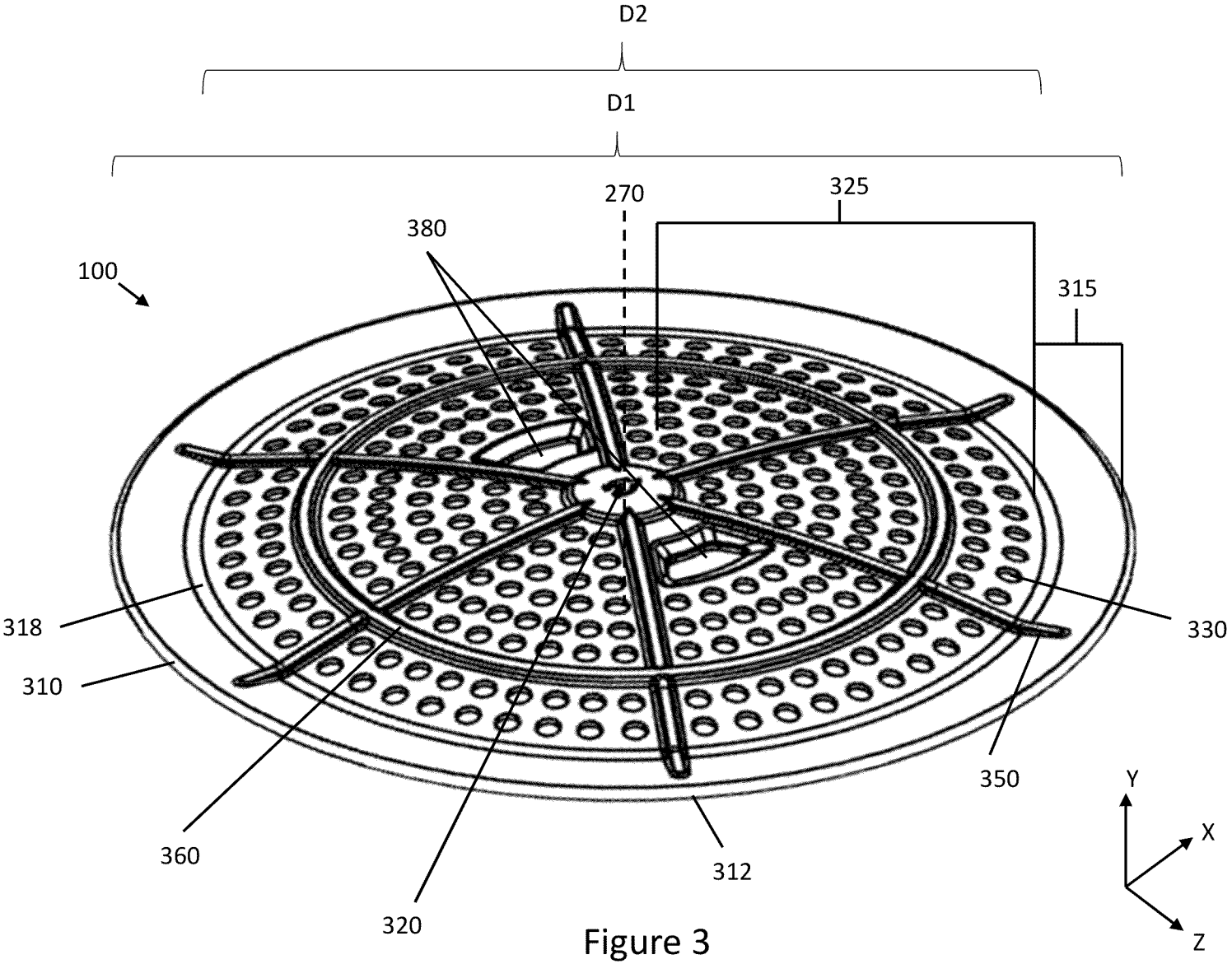
FIG. 3 is an exemplary representation of a fire grate for a wood burning fire pit, in accordance with at least one embodiment of the present disclosure.

FIG. 3 is an exemplary representation of a fire grate 100 for a wood burning fire pit in accordance with at least one embodiment of the present disclosure. In the example shown in the figure, the fire grate is a circular, convex, ventilated dome-shaped structure 325 surrounded by a stiff outer ring 315. The outer ring 315 includes an outer rim 310 with a downward-facing lip or rollover 312 that provides stiffness, that fits into the upward facing lip or rollover 112 of the inner body 110 of the firepit 150, and makes it more difficult for the outer rim 310 of the fire grate 100 to dent, warp, or otherwise deform. The outer rim 310 may define the axis 270. In this example, the fire grate 100 further includes a central hub 320 that is raised above the outer rim 310. The ventilated dome 325 reaches from the inner edge 318 of the stiff outer ring 315 to the outer edge the central hub 320. The ventilated dome 325 includes a plurality of ventilation holes 330, and in some embodiments the stiff outer ring 315 is devoid of ventilation holes.

The fire grate 100 has an outer diameter D1, matched to an inner diameter of the inner body 110. The outer diameter D1 may be in a range of about 9 inches to 48 inches although other sizes larger and smaller are contemplated. The dome portion 325 has an outer diameter D2, which is less than D1. The outer diameter D2 may be in a range of about 1 inch to 9 inches smaller than diameter D1, although other sizes larger and smaller are contemplated. In an example, the fire grate 100 includes 258 circular ventilation holes 330, each having a diameter of about 10 mm. Other numbers and sizes of holes could be used (e.g., 50-800 holes, each with a diameter of between 0.5 cm and 1.5 cm). While more holes and/or larger holes would mean better overall ventilation, it may mean less structural material and thus a weaker structure for both the ventilated dome portion 325 and the fire grate 100 overall. Because better ventilation may result in higher combustion temperatures, the structure may weaken further due to a combination of heat softening and heat expansion. A weaker structure may have a reduced ability to support the weight of firewood or other fuel piled on top of it (see FIG. 1), and may be more prone to collapse or warping. Conversely, fewer holes and/or smaller holes may result in a stronger overall structure and better support for firewood or other fuel, it may also result in worse ventilation and thus a lower combustion temperature, less head output, and increased generation of smoke.

The fire grate 100 in the example shown in FIG. 3 may further include a plurality of radial stiffening ribs 350 that reach from the outer stiffening ring 315 to, or partway to, the central hub 320. In the example shown in FIG. 2, six stiffening ribs 350 reach all the way to the central hub 320. Depending on the implementation, other lengths or numbers of stiffening ribs 350 could be used, including some ribs of a first length and other ribs of a second or third length. It is noted that adding more radial stiffening ribs 350 may leave room for fewer ventilation holes, while removing radial stiffening ribs 350 may create a weaker, less stiff, structure that is more prone to crushing and/or warping.

In addition to the plurality of ventilation holes 330, the ventilated dome 325 includes a concentric stiffening ring 360 that provides additional strength, stiffness, and stability to the structure of the fire grate 100, both at ambient temperature and at operating temperatures when a fire is burning in the fire pit 150 that includes the fire grate (see FIG. 1). In some embodiments, the stiffening ring 360 has a taller profile than the stiffening ribs 350. In other embodiments, the fire grate 100 could include more than one stiffening ring. For example, some embodiments include between 2 and 5 stiffening rings. Even greater numbers of stiffening rings are contemplated. However, increasing the number of stiffening rings may reduce the number or size of the ventilation holes 330, with effects as described above, or else decrease the spacing between the ventilation holes 330, which may weaken the structure of the fire grate 100. In still other embodiments, the fire grate 100 may include no stiffening rings, which may result in a weaker, less stiff structure with more space available for ventilation holes. In some embodiments, the central hub 320 is not present.

In an example, the hub 320, stiffening ribs 350, and stiffening ring 360 are stamped or otherwise embossed into the material of the fire grate (e.g., stainless steel), although other fabrication methods may be employed. In an example, the dome portion 325 is a spherical section with a radius of curvature larger than one-half of a width or diameter of the fire grate. In an example, the fire grate 100 is formed from a flat, circular blank by a stamping process. In an example, the holes 330 are also formed by the stamping process, although they may alternatively be produced by drilling, laser cutting, or other methods.

In some embodiments, one or more of the holes 330 may overlap with one or more of the stiffening ribs 350, or stiffening ring 360. However, in other embodiments the hole pattern, rib pattern, and ring pattern have been selected such that no holes 330 overlap with any of the ribs 350, or ring 360.

In the example shown in FIG. 3, the removable fire grate 100 also includes two grip features, shown in this example as handles 380. In other implementations, the grip features may be shaped to interface with a fire grate removal tool. As shown, the handles are formed as openings larger than the ventilation holes 330. In the implementation shown, each of the handles or openings 380 are sized and shaped to receive human fingers and thus to serve as handles for lifting the removable fire grate 100 out of the fire pit 150 through the cavity or burn chamber 190. The handles 380 may be sized or shaped differently than shown herein, and may be of different number. For example, the fire grate may include one handle, three handles, or a larger number of handles.

Figure 4:
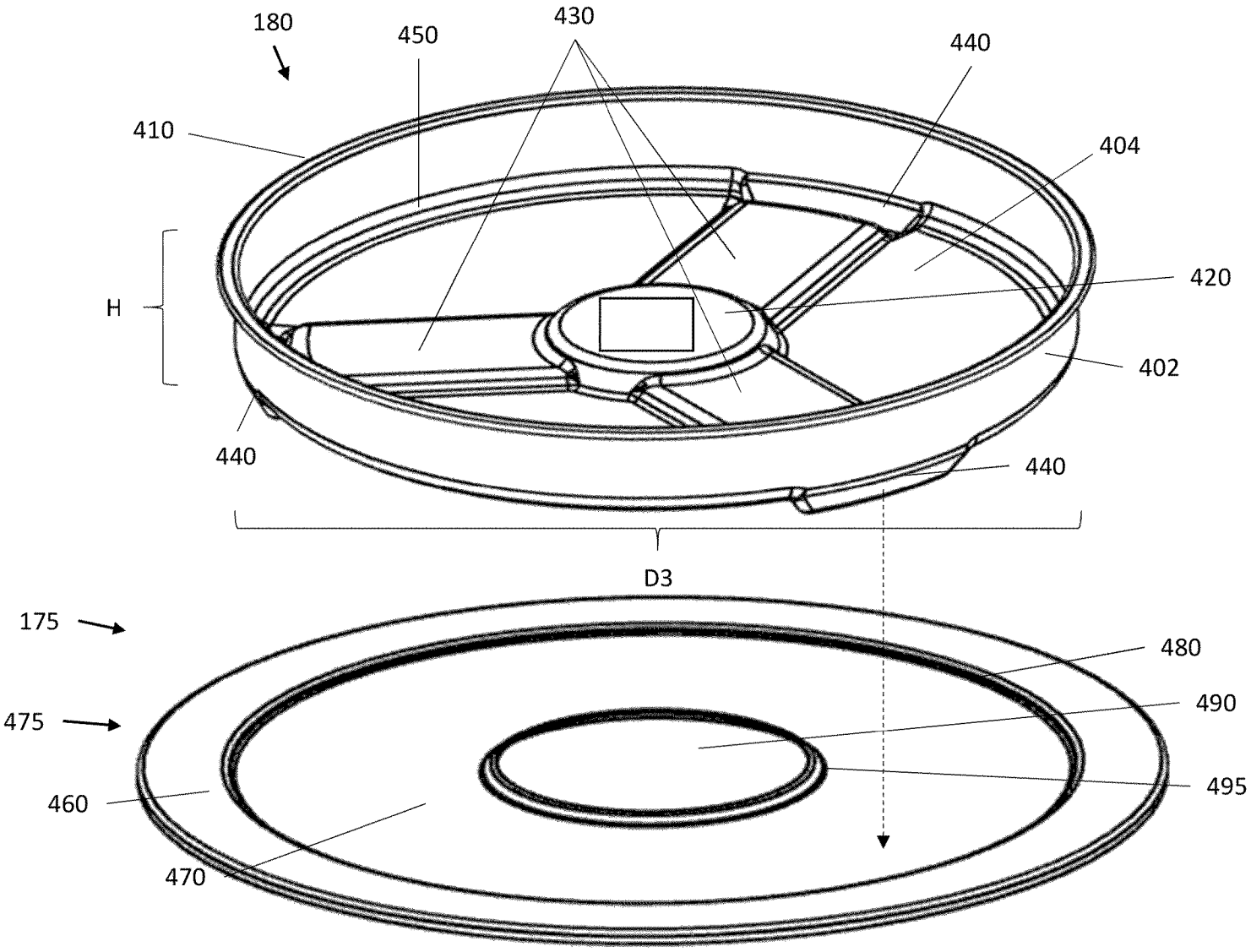
FIG. 4 is a perspective view of an example ash pan and bottom portion of the bracing tray for a wood burning fire pit, in accordance with at least one embodiment of the present disclosure.

FIG. 4 is a perspective view of an example ash pan 180 and bottom portion 475 of the bracing tray 175 for a wood burning fire pit, in accordance with at least one embodiment of the present disclosure. The ash pan 180 has a diameter D3 which is less than the diameter D1 of the fire grate, and which may be comparable to the diameter D2 of the ventilated dome portion 325 of the fire grate 100. Diameter D3 may be in a range of about 7 inches to 47 inches, although larger and smaller sizes are contemplated. In some implementations, the diameter D3 is in a range of about 10 inches to 22 inches. In some implementations, the ventilated portion of the fire grate (e.g., the ventilated dome portion 325, includes a width (e.g., a diameter) that is equal to or smaller than the width of the ash pan. Thus, when fuel 160 combusts to ash 162, the ash 162 can fall through the ventilation holes 330 in the dome portion 325 of the fire grate 100 and then fall downward into the ash pan 180. The ash pan 180 has an interior volume that determines how much ash 162 it can hold before it needs to be emptied. The interior volume of the ash pan 180 is determined at least in part by the height H and diameter D3 of the ash pan 180.

The ash pan 180 includes a side wall 402 and bottom 404. The side wall 402 includes a top lip 410, which may for example be a rolled or folded lip. In the example shown in FIG. 4, the ash pan bottom 404 includes an upward-embossed central hub 420, three radial stiffening arms 430, and three downward-embossed feet 440 disposed at or near the outer edge 450 of the ash pan bottom 404. Other sizes, shapes, and numbers of feet may be used instead of or in addition to the three feet shown in FIG. 4. For example, some embodiments include only two feet, sized and shaped to provide stability for the removable ash pan 180, while other embodiments include four or more feet. The sizes and shapes of the central hub 420, radial stiffening arms 430, and feet 440 may differ from those shown in FIG. 4, and some embodiments may have different numbers of feet 440 or stiffening arms 430, or may lack the hub 420 and/or stiffening arms 430 altogether.

When correctly placed in the fire pit 150, the ash pan 180 rests on the bottom 475 of the bracing tray 175. The bracing tray bottom 475 includes a raised outer ring 460 and a lowered inner ring 470, separated by a centering rim 480. The bracing tray bottom 475 also includes a ventilation opening 490, through which air can flow during combustion of the fuel 160 in the fire pit 150. The feet 440 of the ash pan 180 rest on the bracing tray bottom 475 such that they are nested against the centering rim 480. This permits both the self-centering of the ash pan 180 within the fire pit 150, and the maintenance of air gap 178 between the ash pan 180 and the bracing tray 175, with minimal effort or precision required on the part of the user.

In an example, the diameter D3 of the ash pan is less than the diameter D1 of the fire grate 100 (and thus less than the inner diameter of the inner body 110) by an amount large enough to admit a user's fingers. The lip 410 or side wall 402 may they form one or more grippable surfaces which enable the user to grasp the ash pan 180 and lift it vertically upward through the burn chamber 190 of the fire pit 150, or else return it into the fire pit 150 by lowering it vertically through the burn chamber 190.

In an example, because the central hub 420 and the radial stiffening arms 430 increase the strength and stiffness of the removable ash pan 180, the overall thickness (and thus, weight) of the ash pan can be reduced, without substantially increasing the risk of heat-related warping, or of denting or other damage occurring from handling of the ash pan 180. In an example, the removable ash pan 180 may be produced quickly and at low cost by stamping a metal blank.

Figure 5:
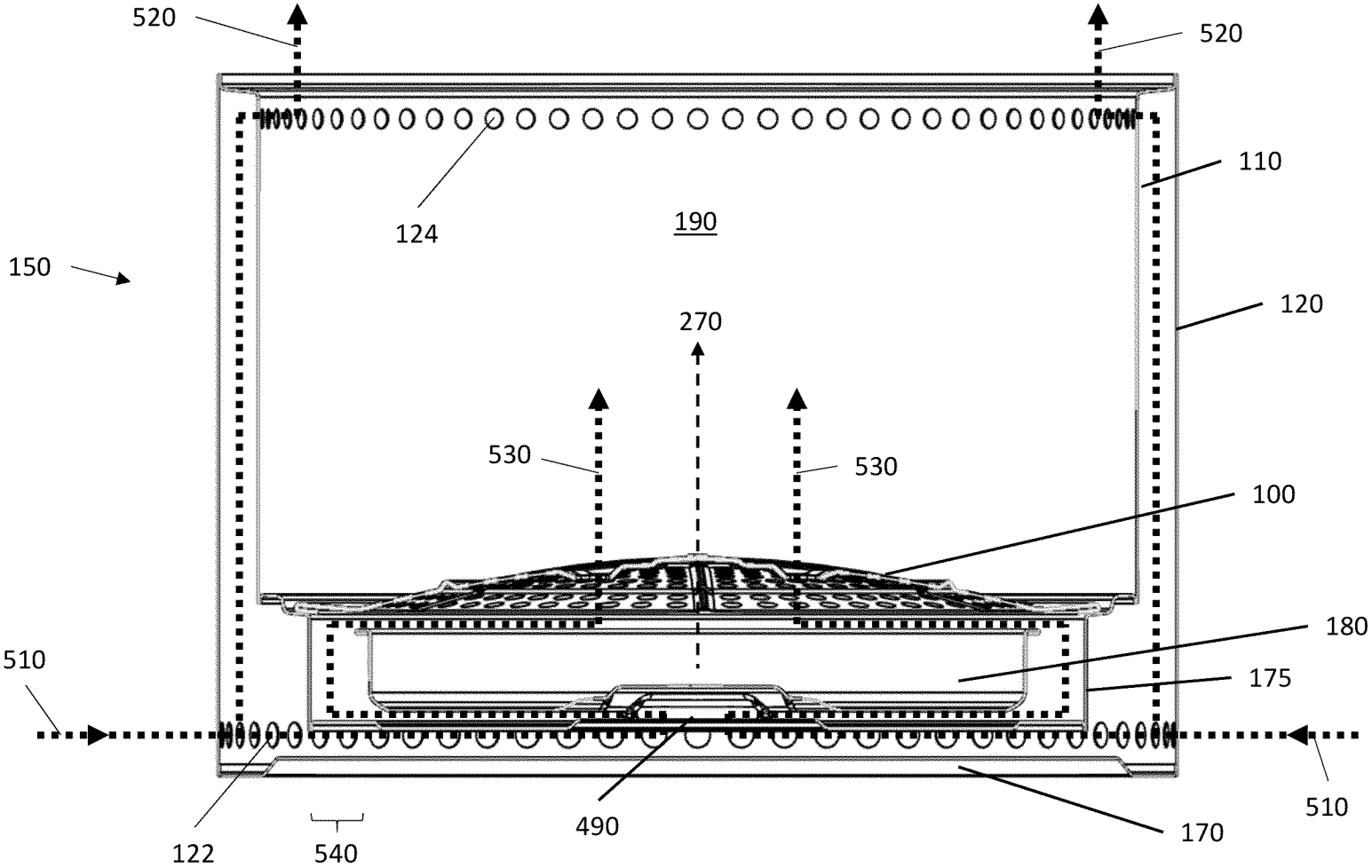
FIG. 5 is cross-sectional side view of air flow through an example fire pit, in accordance with at least one embodiment of the present disclosure.

FIG. 5 is cross-sectional side view of air flow through an example fire pit 150, in accordance with at least one embodiment of the present disclosure. Cold outside air 510 is drawn inward through the ventilation holes 122 located near the bottom of the outer body 120. A portion of this air then becomes cooling air 520 which rises up between the inner body 110 and the outer body 120, then exits into the burn chamber 190 via ventilation holes 124 located near the top of the inner body 110, where it exits the fire pit. Another, different portion of the cool outside air 510 becomes combustion air 530. Combustion air 530 is drawn radially between the base plate 170 and the bracing tray 175 toward the center of the bracing tray 175, and then upward through the ventilation opening 490 in the bracing tray bottom. The combustion air 530 is then drawn radially outward along the bottom of the ash pan 180, then upward around the edges of the ash pan 180, then radially inward along the top of the ash pan 180. The combustion air 530 is then drawn upward through the ventilation holes in the fire grate 100 and into the burn chamber 190, where it can interact with combusting fuel.

A gap 540 exists between the lip of the ash pan 180 and the side of the bracing tray 175. In some embodiments, this gap 540 is large enough to admit human fingers, thus enabling a user to grab the ash pan when it is cool, and remove it from the fire pit 150. Arrow or axis 270 shows the direction the fire grate 100 and ash pan 180 may be lifted, in order to remove them from the fire pit 150.

The flow of cooling air 520 between the inner body 110 and outer body 120 may serve to cool both the inner body 110 and outer body 120. The flow of combustion air 530 toward the ventilation opening 490 of the bracing tray 175 may serve to cool the base plate 170 and bracing tray 175. The flow of combustion air 530 between the bracing tray and ash pan 180 may serve to cool both the bracing tray 175 and the ash pan 180. Thus, the wall of the outer body 120 is insulated by a layer of moving air, and the base plate 170 is insulated by three separate layers of moving air. This enables the exterior portions of the fire pit 150 (e.g., the outer body 120 and the base plate 170) to be much cooler than the burn chamber 190 or fire grate 100, thus improving the safety of the fire pit and decreasing the chance of accidental burning of people, animals, or objects that may contact the exterior of the fire pit 150.

Additionally, the large flow of air 530 through the fire pit helps to ensure that the fuel 160 (see FIG. 1) is well oxygenated and thus burns at high temperature. This in turn maximizes the heat generated by a given quantity of fuel, while simultaneously minimizing the amount of smoke generated by the combustion.

Figure 6:
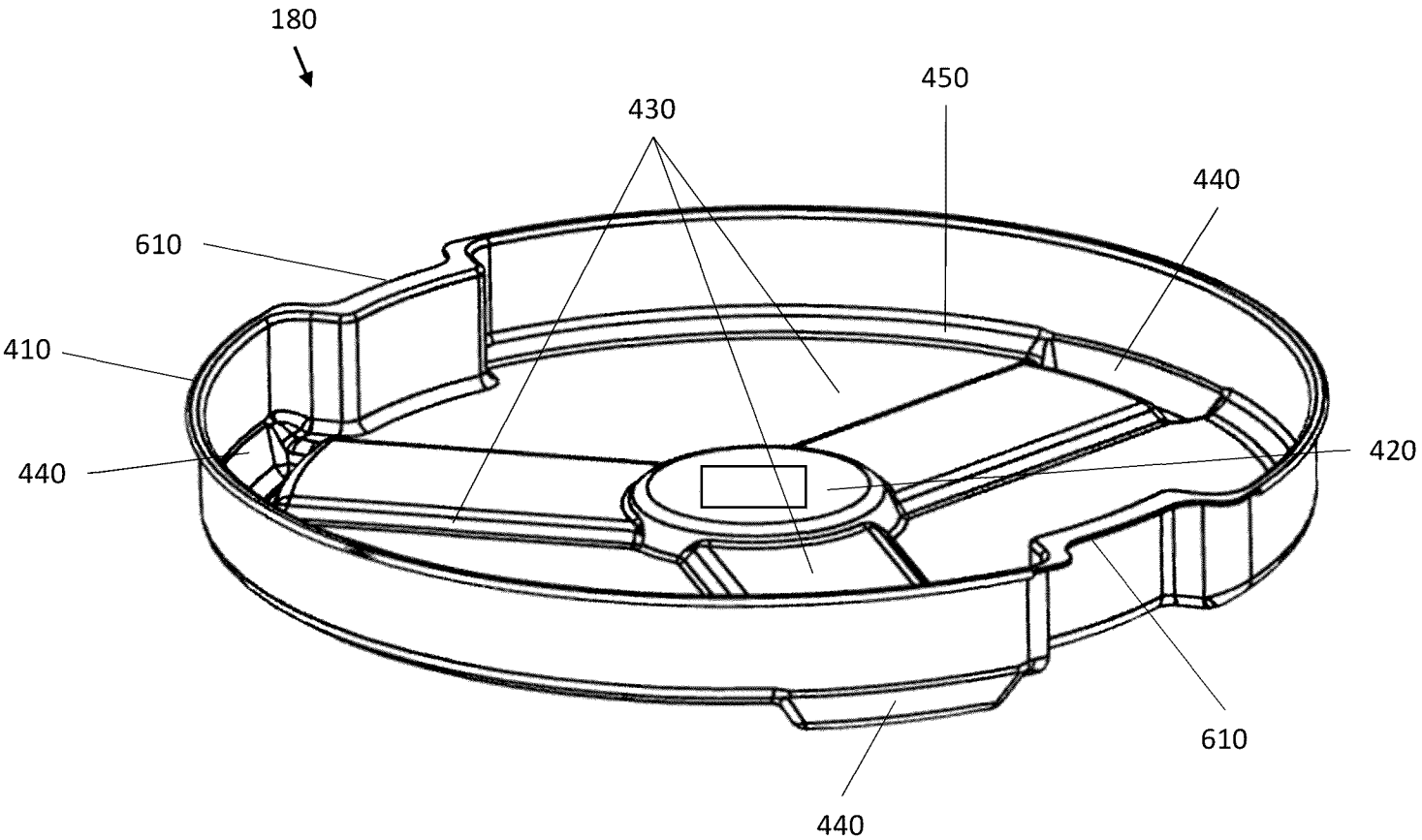
FIG. 6 is a perspective view of another embodiment of an ash pan for a wood burning fire pit, in accordance with at least one embodiment of the present disclosure.

FIG. 6 is a perspective view of another embodiment of an ash pan 180 for a wood burning fire pit, in accordance with at least one embodiment of the present disclosure. Like the embodiment shown in FIG. 4, the ash pan 180 includes a top lip 410, an upward-embossed central hub 420, three radial stiffening arms 430, and three downward-embossed feet 440 disposed at or near the outer edge of the ash pan bottom. When correctly placed in the fire pit 150, the ash pan 180 rests on the bottom of the bracing tray, such that the feet 440 of the ash pan 180 are nested against a centering feature of the bracing tray. The sizes and shapes of the central hub 420, radial stiffening arms 430, and feet 440 may differ from those shown in FIG. 6, and some embodiments may have different numbers of feet 440 or stiffening arms 430, or may lack the hub 420 and/or stiffening arms 430 altogether.

Unlike the embodiment shown in FIG. 4, the embodiment shown in FIG. 6 includes two formed handles 610, which are sized and shaped to admit human fingers between the handles 610 and the sides of the bracing tray. This permits a user to grab and lift the ash pan 180 when it is cool, and when the fire grate has been lifted out of the way.

Figure 7:
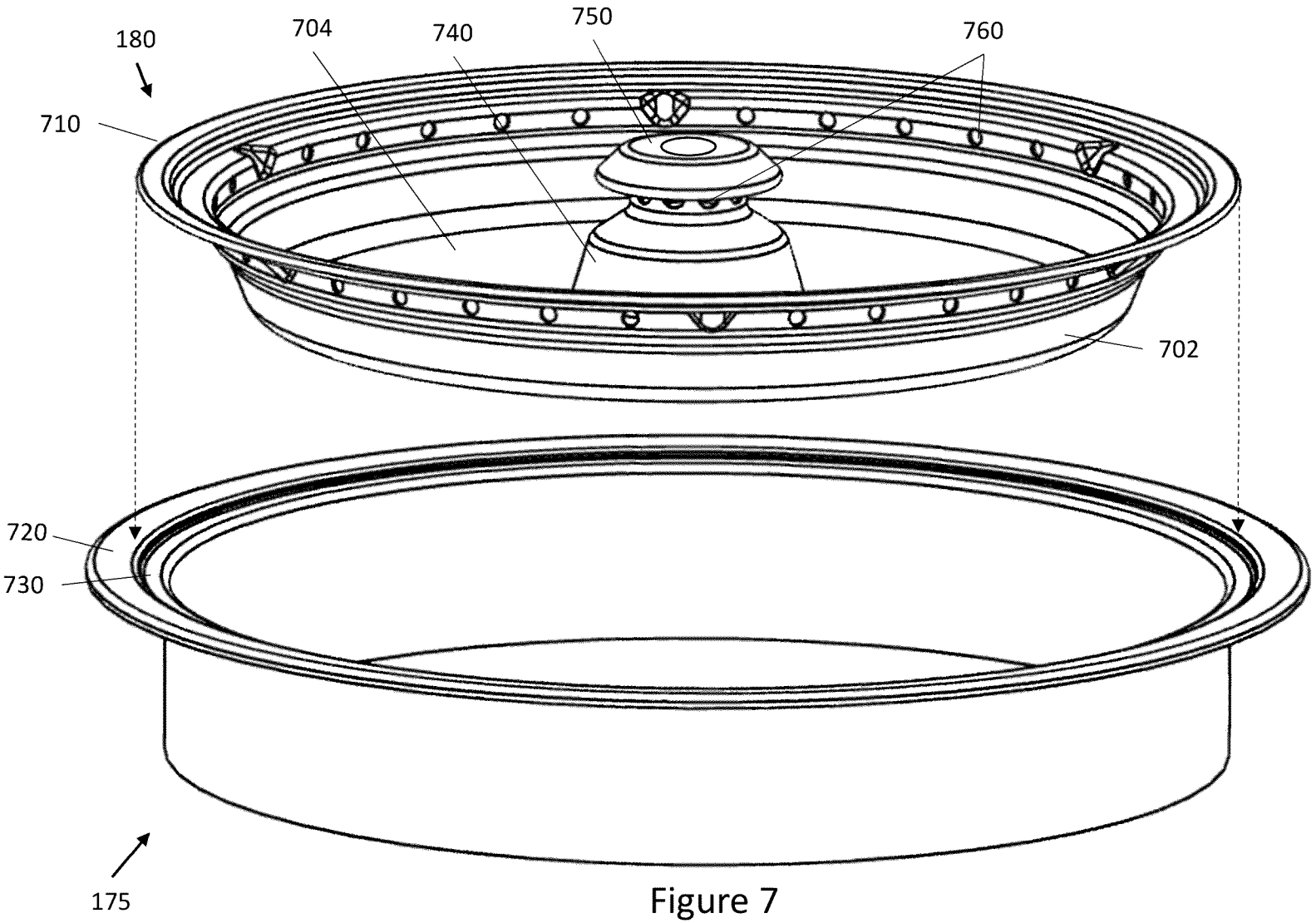
FIG. 7 is a perspective view of another embodiment of an ash pan for a wood burning fire pit, in accordance with at least one embodiment of the present disclosure.

FIG. 7 is a perspective view of another embodiment of an ash pan 180 for a wood burning fire pit, in accordance with at least one embodiment of the present disclosure. In the embodiment shown in FIG. 7, the ash pan 180 does not include feet that rest on the bottom of the bracing tray 175. Rather, the ash pan 180 includes a lip 710 designed to hang from a recessed ring 730 in the rim 720 of the bracing tray 175. In addition, a central feature, cone, or tower 740 rises up from the base 704 of the ash pan, and includes a cap 750 that may for example be used as a handle to lift the ash pan 180 out of the fire pit 150, or return the ash pan 180 into the fire pit 150.

Since air cannot travel around the lip 710 of the ash pan 180 while it is hanging from the bracing tray 175, ventilation holes 760 are provided both in the side wall 702 of the ash pan 180 and in the central tower 740. The size, shape, and positioning of the tower 740, cap 750, or ventilation holes 760 may be different than shown in FIG. 7. The number of ventilation holes may also be different, ranging from one ventilation hole to a large plurality of ventilation holes.

The removable ash pan provides a low-cost, lightweight, stampable, high-strength, high-stiffness, high-airflow structure that is readily removable from the fire pit for emptying and cleaning. Similarly, the removable fire grate advantageously provides a low-cost, lightweight, stampable, high-strength, high-stiffness, high-airflow structure that resists denting, warping, and other deformation while carrying heavy fuel loads at operating temperatures as high as about 1350° F. (732° C.), and while cycling repeatedly between ambient temperature and operating temperature.

A number of variations are possible on the examples and embodiments described hereinabove. For example, the fire grate, ash pan, or other components could be made of heavier-gauge material in order to support more weight, or of lighter gauge material in order to become lighter and more portable. The fire grate could be made in different sizes and/or with different degrees of curvature. The ash pan could be made in different sizes, and with different depths. Air gaps may be larger or smaller than shown herein, to optimize air flow through the fire pit, to minimize weight or volume of the fire pit, or for other reasons. The relative lengths, widths, and radii of different components could be different than presented herein. The fire grate, ash pan, or other components could be made by different processes, including casting, forging, sintering, milling, or 3D printing. They could be made of different metals, or of nonmetallic materials such as ceramics. The fire pit rim could be noncircular, including such possible shapes as ovals, rectangles, triangles, and rhombuses. The technology described herein may be used to burn firewood, wood chips or pellets, scrap lumber, paper, cardboard, coal, and other combustible materials. It may be employed for example in lamps, stoves, firepits, fireplaces, furnaces, forges, and boilers, and other combustion heaters. In some implementations, the fire grate, ash pan, or other components may comprise several pieces that collectively form a structure like that described herein.

Attached hereto is an Appendix that includes Figures A through Z and AA through DD. Specifically, in several embodiments, one or more of the embodiments of the present application are provided in whole or in part as described and illustrated in the Appendix, which forms part of the present application. Moreover, Figures A through Z and AA through DD provide additional support for any U.S. or non-U.S. design applications that are to be filed in the future claiming priority to this present U.S. utility patent application. More particularly, in the Appendix:

Figure A is a top view of a new, original design for a removeable fire grate;
Figure B is a front elevational view thereof;
Figure C is a left side elevational view thereof. The right side elevational view is the same.
Figure D is a perspective top view thereof;
Figure E is a cross-sectional plan view thereof; and
Figure F is a cross-sectional plan view thereof rotated 90 degrees from Figure E.
Figure G is a top view of a new, original design for an ash pan usable with the removable fire grate in Figures A-F;
Figure H is a front elevational view thereof;
Figure I is a left side elevational view thereof. The right side elevational view is the same.
Figure J is a perspective top view thereof;
Figure K is a cross-sectional plan view thereof; and
FIG. L is a cross-sectional plan view thereof rotated 90 degrees from Figure K.
Figure M is a perspective view of a new, original design for a removable fire grate;
Figure N is a front elevational view thereof;
Figure O is a left side elevational view thereof. The right side elevational view is the same.
Figure P is a perspective top view thereof;
Figure Q is a cross-sectional plan view thereof; and
Figure R is a cross-sectional plan view thereof rotated 90 degrees from Figure Q.
Figure S is a top view of a new, original design for an ash pan usable with the removable fire grate in Figures M-R or Figures A-F;
Figure T is a front elevational view thereof;
Figure U is a left side elevational view thereof. The right side elevational view is mirrored;
Figure V is a perspective top view thereof;
Figure W is a cross-sectional plan view thereof; and
Figure X is a cross-sectional plan view thereof rotated 90 degrees from Figure W.
Figure Y is a top view of a new, original design for an ash pan usable with the removable fire grate in Figures M-R or Figures A-F;
Figure Z is a front elevational view thereof;
Figure AA is a left side elevational view thereof. The right side elevational view is mirrored.
Figure BB is a perspective top view thereof;
Figure CC is a cross-sectional plan view thereof; and
Figure DD is a cross-sectional plan view thereof rotated 90 degrees from Figure CC.

In several embodiments, one or more of the embodiments described and illustrated in the Appendix are combined in whole or in part with one or more of the embodiments described above, illustrated in one or more of FIGS. 1 through 7, one or more other embodiments described and illustrated in the Appendix, or any combination thereof.

The logical operations making up the embodiments of the technology described herein are referred to variously as operations, steps, objects, elements, components, or modules. Furthermore, it should be understood that these may occur or be performed in any order, unless explicitly claimed otherwise or a specific order is inherently necessitated by the claim language.

All directional references e.g., upper, lower, inner, outer, upward, downward, left, right, lateral, front, back, top, bottom, above, below, vertical, horizontal, clockwise, counterclockwise, proximal, and distal are only used for identification purposes to aid the reader's understanding of the claimed subject matter, and do not create limitations, particularly as to the position, orientation, or use of the fire grate, ash pan, or fire pit. Connection references, e.g., attached, coupled, connected, and joined are to be construed broadly and may include intermediate members between a collection of elements and relative movement between elements unless otherwise indicated. As such, connection references do not necessarily imply that two elements are directly connected and in fixed relation to each other. The term "or" shall be interpreted to mean "and/or" rather than "exclusive or." Unless otherwise noted in the claims, stated values shall be interpreted as illustrative only and shall not be taken to be limiting.

The above specification, examples and data provide a complete description of the structure and use of exemplary embodiments of the fire grate, ash pan, and fire pit as defined in the claims. Although various embodiments of the claimed subject matter have been described above with a certain degree of particularity, or with reference to one or more individual embodiments, those skilled in the art could make numerous alterations to the disclosed embodiments without departing from the spirit or scope of the claimed subject matter. Still other embodiments are contemplated. It is intended that all matter contained in the above description and shown in the accompanying drawings shall be interpreted as illustrative only of particular embodiments and not limiting. Changes in detail or structure may be made without departing from the basic elements of the subject matter as defined in the following claims.

What is claimed is:

1. A fire pit comprising:

an outer wall and an inner wall, the inner wall being spaced from the outer wall to form an air passage therebetween, the inner wall having an inwardly facing surface and defining a burn chamber having a chamber width;

a bottom wall forming a bottom portion of the fire pit;

a removable fuel grate disposed within the burn chamber above the bottom wall, the removable fuel grate having a grate width sized to allow the removable fuel grate to be vertically displaced from a first position within the burn chamber that supports combustible fuel during use to a second position outside the burn chamber, the removable fuel grate comprising:

a sheet metal dome portion having an array of holes sized to permit air flow from below the removable fuel grate and sized to permit passage of ash from the combustible fuel; and a handle portion shaped to be grasped by a user to permit the user to remove the removable fuel grate from the fire pit by lifting the removable fuel grate vertically through the burn chamber;

an air chamber below the removable fuel grate;

an ash pan disposed below the array of holes to capture ash passing through the array of holes from the combustible fuel when the combustible fuel is burned in the burn chamber, the ash pan having sidewalls and a bottom, the bottom having a pan width smaller than the grate width; and a support between the bottom wall and the ash pan, the support being disposed to support the ash pan in a position below the fuel grate and above the bottom wall in a manner allowing flow of air between the bottom wall and the ash pan.

2. The fire pit of claim 1, the support being configured to provide passage of air toward the air chamber below the removable fuel grate, the bottom of the ash pan and the support defining a horizontal, radially outwardly directed passageway from a central hole in the support to allow air to flow to the air chamber below the removable fuel grate.

3. The fire pit of claim 1, wherein the support comprises a central hole therein to provide the passage of air toward the air chamber below the removable fuel grate.

4. The fire pit of claim 1, wherein the removable fuel grate comprises a perimeter edge portion, the fire pit comprising a support structure that supports the removable fuel grate from only the perimeter edge portion in a manner disposing the removable fuel grate above the ash pan.

5. The fire pit of claim 1, wherein a diameter of the ash pan is smaller than a diameter of the air chamber, such that an air gap is formed between a side wall of the ash pan and an inner wall of the air chamber.

6. The fire pit of claim 1, wherein the ash pan is in contact with the support by a plurality of embossments.

7. The fire pit of claim 1, wherein the support contacts the inner wall at a perimeter of the support.

8. A fire pit comprising:

an outer wall and an inner wall, the inner wall being spaced from the outer wall to form an air passage therebetween, the inner wall having an inwardly facing surface and defining a burn chamber having a chamber width;

a bottom wall forming a bottom portion of the fire pit;

a fuel grate above the bottom wall and forming a part of the burn chamber, the fuel grate comprising an array of holes sized to permit air flow from below the fuel grate and sized to permit passage of ash from a combustible fuel burned in the burn chamber;

an air chamber below the fuel grate;

an ash pan disposable below the array of holes of the fuel grate to capture ash passing through the array of holes from the combustible fuel when the combustible fuel is burned in the burn chamber, the ash pan having sidewalls and a bottom, the ash pan being unfixed relative to each of the inner wall, the outer wall, and the fuel grate, the ash pan being configured in a manner permitting axial separation of the ash pan and both the inner wall and the outer wall between a first position where the ash pan is located to capture ash from the fuel grate during use to a second position, after the axial separation, displaced from both the inner wall and the outer wall and accessible for cleaning; and a support between the bottom wall and the ash pan, the support being disposed to support the ash pan in a position below the fuel grate and above the bottom wall in a manner allowing flow of air between the bottom wall and the ash pan.

9. The fire pit of claim 8, the support being configured to provide passage of air toward the air chamber below the fuel grate, the bottom of the ash pan and the support defining a horizontal, radially outwardly directed passageway from a central hole to allow air to flow to the air chamber below the fuel grate.

10. The fire pit of claim 9, wherein the fuel grate comprises a perimeter edge portion, the fire pit comprising a support structure that supports the fuel grate from only the perimeter edge portion in a manner disposing the fuel grate above the ash pan.

11. The fire pit of claim 9, wherein a diameter of the ash pan is smaller than a diameter of the air chamber, such that an air gap is formed between a side wall of the ash pan and an inner wall of the air chamber.

12. The fire pit of claim 9, wherein the ash pan is in contact with the support by a plurality of embossments.

13. The fire pit of claim 9, wherein the support contacts the inner wall at a perimeter of the support.

14. A method of using a fire pit, comprising:

introducing a combustible fuel into a burn chamber with an upper opening of a fire pit, the burn chamber having a vertical axis and being defined by an inner wall comprising an upper portion having an internally facing ventilation hole, the inner wall being disposed above a bottom wall and being disposed within an outer wall, the inner wall being spaced from the outer wall to form an air passage therebetween allowing flow of air through the internally facing ventilation hole into the burn chamber;

capturing ash from the combustible fuel while burning that falls through a fuel grate into an ash pan disposed below the fuel grate, the fuel grate having an array of holes therein for passing ash to the ash pan and for passing air to the combustible fuel disposed on the fuel grate, the ash pan being disposed below the fuel grate and above the bottom wall in a manner allowing flow of air over an edge of the ash pan to the array of holes;

increasing separation between the ash pan and both the inner wall and the outer wall by relative displacement in an axial direction to provide access to the ash captured in the ash pan.

15. The method of claim 4, wherein increasing separation between the ash pan and both the inner wall and the outer wall by relative displacement in an axial direction comprises lifting the ash pan through the burn chamber.

16. The method of claim 14, comprising displacing the ash pan relative to the fuel grate by relative axial displacement by lifting the fuel grate through the burn chamber.

17. The method of claim 16, comprising lifting the fuel grate by a handle vertically upwardly.

18. The method of claim 17, wherein lifting the fuel grate by the handle comprises inserting a user's finger through an opening defined by the handle.

19. The method of claim 14, comprising replacing the ash pan to a position below the fuel grate by decreasing separation between the ash pan and both the inner wall and the outer wall by relative displacement in an axial direction.

20. The method of claim 14, further comprising supporting the ash pan on a support between the ash pan and the bottom wall, wherein the support is configured to provide passage of air toward an air chamber below the fuel grate, a bottom of the ash pan and the support defining a horizontal, radially outwardly directed passageway from a central hole in the support to allow air to flow to the air chamber below the fuel grate.

21. The method of claim 20, wherein a diameter of the ash pan is smaller than a diameter of the fuel grate, and wherein an air gap is disposed between a side wall of the ash pan and an inner wall of the air chamber.

22. A fire pit comprising:

an outer wall and an inner wall, the inner wall being spaced from the outer wall to form an air passage therebetween, the inner wall having an inwardly facing surface and defining a burn chamber having a chamber width;

a fuel grate forming a part of the burn chamber, the fuel grate comprising an array of holes sized to permit air flow from below the fuel grate and sized to permit passage of ash from a combustible fuel burned in the burn chamber;

an air chamber below the fuel grate;

an ash pan disposable below the array of holes of the fuel grate to capture ash passing through the array of holes from the combustible fuel when the combustible fuel is burned in the burn chamber, the ash pan having sidewalls and a bottom, the ash pan being unfixed relative to each of the inner wall, the outer wall, and the fuel grate, the ash pan being configured in a manner permitting axial separation of the ash pan and both the inner wall and the outer wall between a first position where the ash pan is located to capture ash from the fuel grate during use to a second position, after the axial separation, displaced from both the inner wall and the outer wall and accessible for cleaning; and a support for the ash pan, the support being disposed to support the ash pan in a position below the fuel grate in a manner allowing flow of air below the ash pan.

23. The fire pit of claim 22, the support being configured to provide passage of air toward the air chamber below the fuel grate, the bottom of the ash pan and the support defining a horizontal, radially outwardly directed passageway from a central hole to allow air to flow to the air chamber below the fuel grate.

24. The fire pit of claim 22, wherein the fuel grate comprises a perimeter edge portion, the fire pit comprising a support structure that supports the fuel grate from only the perimeter edge portion in a manner disposing the fuel grate above the ash pan.

25. The fire pit of claim 22, wherein a diameter of the ash pan is smaller than a diameter of the air chamber, such that an air gap is formed between a side wall of the ash pan and an inner wall of the air chamber.

26. The fire pit of claim 22, wherein the ash pan is in contact with the support by a plurality of embossments.

27. The fire pit of claim 22, wherein the support contacts the inner wall at a perimeter of the support.

* * * * *